US008958720B2

(12) United States Patent
Kamimura

(10) Patent No.: US 8,958,720 B2
(45) Date of Patent: Feb. 17, 2015

(54) PHOTOSENSITIVE MEMBER CARTRIDGE AND PROCESS CARTRIDGE PROVIDED WITH POSITIONING SHAFT FOR IMPROVED POSITIONING ACCURACY

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 204 days.

(21) Appl. No.: 13/598,796

(22) Filed: Aug. 30, 2012

(65) Prior Publication Data

US 2013/0051847 A1 Feb. 28, 2013

(30) Foreign Application Priority Data

Aug. 31, 2011 (JP) ..... 2011-190031

(51) Int. Cl.
*G03G 21/16* (2006.01)
*G03G 21/18* (2006.01)
*G03G 15/00* (2006.01)

(52) U.S. Cl.
CPC ..... *G03G 21/1853* (2013.01); *G03G 15/757* (2013.01); *G03G 21/186* (2013.01)
USPC ..... 399/111; 399/113; 399/119

(58) Field of Classification Search
USPC ..... 399/111, 113, 119
See application file for complete search history.

(56) References Cited

U.S. PATENT DOCUMENTS 7,298,990 B2 11/2007 Nishimura
7,369,792 B2 5/2008 Shiraki
7,386,253 B2 6/2008 Ishii et al.
7,412,188 B2 8/2008 Ishii et al.
7,450,882 B2 11/2008 Shiraki
7,522,859 B2 4/2009 Ishii et al.
7,565,092 B2 7/2009 Shiraki
7,639,967 B2 12/2009 Kamimura
7,643,770 B2 1/2010 Sato et al.
7,693,442 B2 4/2010 Sato et al.
7,693,443 B2 4/2010 Sato et al.
7,796,915 B2 9/2010 Ishii et al.
7,826,767 B2 11/2010 Sato et al.

(Continued)

FOREIGN PATENT DOCUMENTS

CN 1661500 A 8/2005
CN 1731293 A 2/2006

(Continued)

OTHER PUBLICATIONS

First Office Action issued in corresponding Chinese Patent Application No. 201210324348.7 mailed Mar. 5, 2014.

*Primary Examiner* — David Gray
*Assistant Examiner* — Laura Roth
(74) *Attorney, Agent, or Firm* — Banner & Witcoff, Ltd.

(57) ABSTRACT

The photosensitive member cartridge includes: a photosensitive member; a mounting portion; and a shaft. The photosensitive member has an axis extending in an axial direction. The mounting portion is configured to accommodate a developing cartridge therein. The shaft extends in the axial direction. The shaft includes: a first abutment portion configured to be abuttable on the developing cartridge when the developing cartridge is mounted in the mounting portion; and a positioned portion configured to be subjected to positioning with respect to a main casing of an image forming apparatus when the photosensitive member cartridge is mounted in the main casing of the image forming apparatus.

17 Claims, 8 Drawing Sheets

(56) References Cited

U.S. PATENT DOCUMENTS

| | | | | |
|---|---|---|---|---|
| 7,844,197 | B2 | 11/2010 | Ishii et al. | |
| 7,873,296 | B2 | 1/2011 | Ishii et al. | |
| 7,957,669 | B2 | 6/2011 | Ishii et al. | |
| 8,014,694 | B2 | 9/2011 | Sato et al. | |
| 8,213,826 | B2 | 7/2012 | Sato et al. | |
| 2005/0191090 | A1 | 9/2005 | Nishimura | |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2007/0009281 | A1 | 1/2007 | Sato et al. | |
| 2007/0009282 | A1 | 1/2007 | Sato et al. | |
| 2007/0048008 | A1 | 3/2007 | Kamimura | |
| 2007/0140725 | A1 * | 6/2007 | Kamimura | 399/119 |
| 2007/0223962 | A1 | 9/2007 | Shiraki | |
| 2008/0170882 | A1 | 7/2008 | Ishii et al. | |
| 2008/0279583 | A1 | 11/2008 | Ishii et al. | |
| 2008/0298838 | A1 | 12/2008 | Sato et al. | |
| 2009/0169248 | A1 | 7/2009 | Ishii et al. | |
| 2009/0169257 | A1 | 7/2009 | Sato et al. | |
| 2010/0296833 | A1 | 11/2010 | Sato et al. | |
| 2011/0064461 | A1 | 3/2011 | Ishii et al. | |
| 2011/0299875 | A1 | 12/2011 | Sato et al. | |
| 2012/0251187 | A1 | 10/2012 | Sato et al. | |
| 2014/0044453 | A1 | 2/2014 | Sato et al. | |
| 2014/0044454 | A1 | 2/2014 | Sato et al. | |
| 2014/0044455 | A1 | 2/2014 | Sato et al. | |
| 2014/0050508 | A1 | 2/2014 | Sato et al. | |

FOREIGN PATENT DOCUMENTS

| | | | |
|---|---|---|---|
| CN | 1892485 | A | 1/2007 |
| CN | 101614987 | A | 12/2009 |
| JP | 2007-057646 | A | 3/2007 |
| JP | 2009-162905 | A | 7/2009 |

* cited by examiner

PHOTOSENSITIVE MEMBER CARTRIDGE AND PROCESS CARTRIDGE PROVIDED WITH POSITIONING SHAFT FOR IMPROVED POSITIONING ACCURACY

CROSS REFERENCE TO RELATED APPLICATION

This application claims priority from Japanese Patent Application No. 2011-190031 filed Aug. 31, 2011. The entire content of the priority application is incorporated herein by reference.

TECHNICAL FIELD

The present invention relates to a photosensitive member cartridge and a process cartridge, detachably mountable in a main casing of an image forming apparatus.

BACKGROUND

Known is an image forming apparatus, such as a laser printer, provided with a process cartridge including a developing cartridge and a drum cartridge. The developing cartridge has a developing roller. The drum cartridge has a photosensitive drum. In the process cartridge, the developing cartridge is mounted in the drum cartridge. A combination of the developing cartridge and the drum cartridge as the process cartridge is integrally detachable from or attachable to a main casing of the image forming apparatus.

The drum cartridge has a drum frame for supporting the photosensitive drum. The drum frame has a cartridge accommodating portion in which the developing cartridge is accommodated. Further, the drum frame is provided with a roller. The roller is disposed at the cartridge accommodating portion.

The developing cartridge has a developing frame for supporting the developing roller. The developing frame is provided with a roller receiving portion for receiving the roller of the drum cartridge. The roller receiving portion is disposed at a position in confrontation with the roller provided at the drum frame when the developing cartridge is mounted in the drum cartridge.

When the developing cartridge is mounted in the drum cartridge, the developing frame is accommodated in the cartridge accommodating portion while the developing frame is brought into abutment with the roller. Further, the developing roller is brought into contact with the photosensitive drum. Hence, assembly of the developing cartridge relative to the photosensitive cartridge is achieved.

At this time, the roller provided at the drum frame is in abutment with the roller receiving portion provided at the developing frame. Abutment of the roller with the roller receiving portion regulates the movement of the developing frame, thereby positioning the developing cartridge relative to the drum cartridge.

SUMMARY

However, in the above-described configuration, in case the drum frame is deformed by heat, a relative positional relationship between the roller and the roller receiving portion may be disrupted. Disruption of the relative positional relationship may cause degradation of positioning accuracy of the developing cartridge relative to the drum cartridge.

In other words, provided that positioning accuracy of the developing cartridge relative to the drum cartridge is degraded, positioning accuracy of the drum cartridge and the developing cartridge relative to the main casing is also degraded when the process cartridge is mounted in the main casing.

In view of the foregoing, it is an object of the present invention to provide a photosensitive member cartridge and a process cartridge that achieve enhanced positioning accuracy of the photosensitive member cartridge and the process cartridge relative to a main casing of an image forming apparatus.

In order to attain the above and other objects, the present invention provides a photosensitive member cartridge configured to be mounted in a main casing of an image forming apparatus and configured to accommodate therein a developing cartridge having a developing agent bearing member. The photosensitive member cartridge includes a photosensitive member; a mounting portion; and a shaft. The photosensitive member has an axis extending in an axial direction. The mounting portion is configured to accommodate the developing cartridge therein. The shaft extends in the axial direction. The shaft includes: a first abutment portion configured to be abutted on the developing cartridge when the developing cartridge is mounted in the mounting portion; and a positioned portion configured to be subjected to positioning with respect to the main casing when the photosensitive member cartridge is mounted in the main casing.

According to another aspect, the present invention provides a process cartridge including: the foregoing photosensitive member cartridge; and a developing cartridge configured to be mounted in the mounting portion of the photosensitive member cartridge.

BRIEF DESCRIPTION OF THE DRAWINGS

The particular features and advantages of the invention as well as other objects will become apparent from the following description taken in connection with the accompanying drawings, in which:

FIGS. 6A and 6B are explanatory views illustrating positioning of the process cartridge relative to a main casing of the printer shown in FIG. 1, in which FIG. 6A is a left side view of the process cartridge; and FIG. 6B is an enlarged view of an essential portion of the process cartridge shown in FIG. 6A;

FIGS. 8A and 8B are explanatory views illustrating a lock mechanism how to lock a developing cartridge relative to the drum cartridge in a process cartridge according to the second embodiment, in which FIG. 8A shows the process cartridge in which the developing cartridge is mounted in the drum cartridge in a locked state; and FIG. 8B shows the process cartridge in which the developing cartridge is mounted in the drum cartridge in an unlocked state, and a front portion of the developing cartridge is moved upward and away from the drum cartridge.

DETAILED DESCRIPTION

Figure 1:
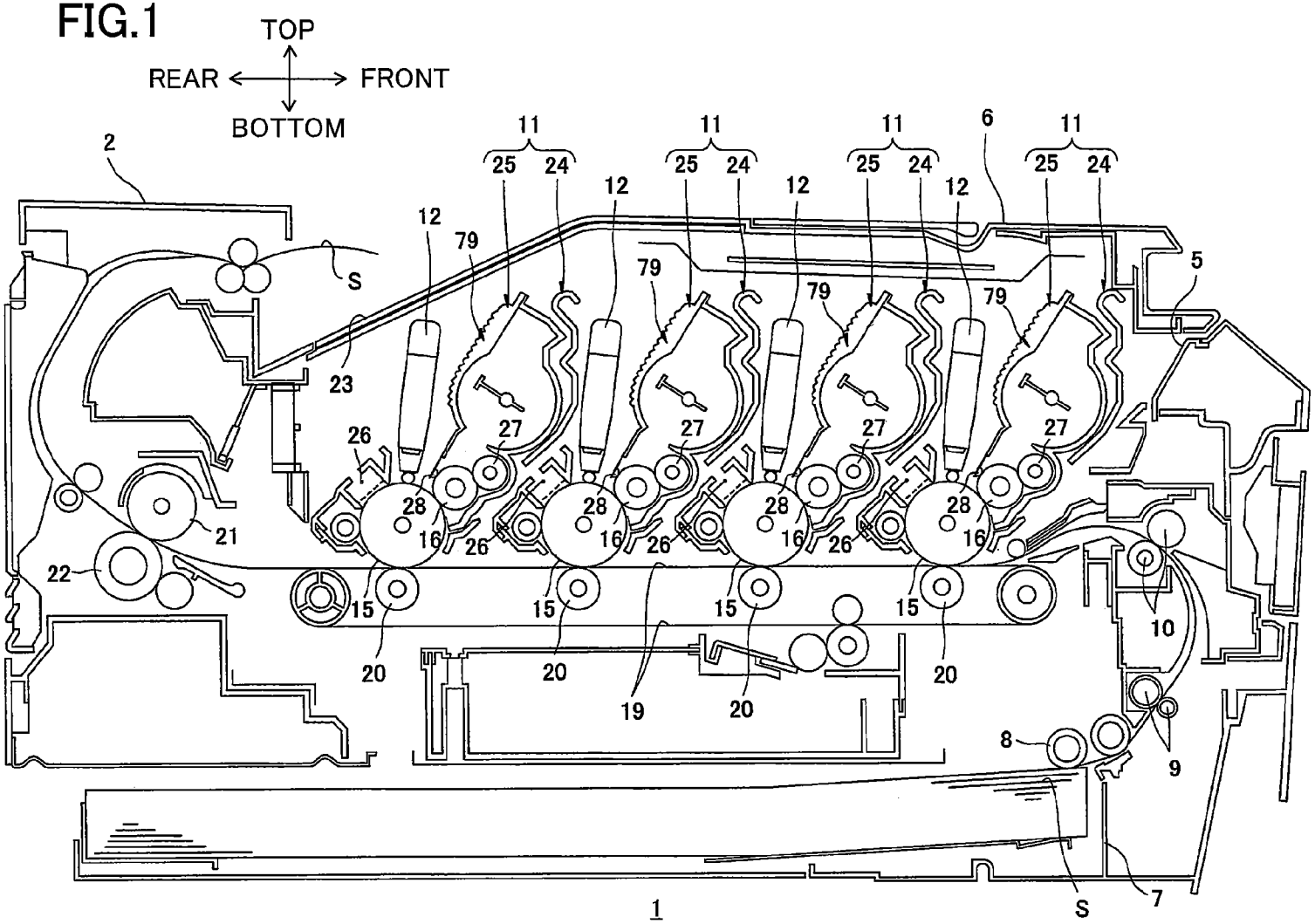
FIG. 1 is a cross-sectional view of a printer in which a process cartridge according to a first embodiment of the present invention is mounted.

A drum cartridge and a process cartridge according to a first embodiment of the present invention, detachably mountable in an image forming apparatus, will be described while referring to FIGS. 1 through 6B wherein like parts and components are designated by the same reference numerals to avoid duplicating description.

1. Overall Structure of Color Printer

As shown in FIG. 1, the image forming apparatus is a horizontal direct tandem type color printer 1.

The terms "upward", "downward", "upper", "lower", "above", "below", "beneath", "right", "left", "front", "rear" and the like will be used in the following description assuming that the printer 1 is disposed in an orientation in which it is intended to be used, unless otherwise specified. In the following description, the right side in FIG. 1 will be referred to as the front side of the printer 1, and the left side in FIG. 1 will be referred to as the rear side of the printer 1. Top, bottom, left, and right sides of the printer 1 in the following description will be based on the reference point of a user viewing the printer 1 from the front side. The near side in FIG. 1 will be referred to as the left side of the printer 1, and the far side in FIG. 1 will be referred to as the right side of the printer 1.

The printer 1 includes a main casing 2 formed in a generally box-shape. The main casing 2 has a top portion at which a top cover 6 is provided. The top cover 6 is pivotally movable about its rear portion between a closed position for closing an opening 5 formed in the main casing 2 and an open position for opening the opening 5. The printer 1 further includes four process cartridges 11 corresponding to each color.

Four of the process cartridges 11 are detachably mounted in the main casing 2 and juxtaposed with each other in a frontward/rearward direction with a space between neighboring process cartridge 11. Further, each of the process cartridges 11 includes a drum cartridge 24 and a developing cartridge 25. The developing cartridge 25 is detachably mountable in the drum cartridge 24.

The drum cartridge 24 includes a photosensitive drum 15.

The photosensitive drum 15 is formed in a cylindrical shape that is elongated in a rightward/leftward direction (lateral direction). That is, the photosensitive drum 15 is oriented with its axis in the rightward/leftward direction. The rightward/leftward direction corresponds to an axial direction of the photosensitive drum 15. The photosensitive drum 15 is rotatably supported in the drum cartridge 24.

The developing cartridge 25 includes a developing roller 16.

The developing roller 16 is rotatably supported in the developing cartridge 25 so that a lower rear edge of the developing roller 16 is exposed through a lower rear edge of the developing cartridge 25 and contacts the corresponding photosensitive drum 15 from an upper front thereof.

Further, the developing cartridge 25 includes a supply roller 27 for supplying toner to the developing roller 16, and a thickness-regulating blade 28 for regulating the thickness of the toner supplied to the developing roller 16. The developing cartridge 25 also includes a toner accommodating portion 79 for accommodating toner therein. The toner accommodating portion 79 is disposed above the supply roller 27 and the thickness-regulating blade 28.

The toner accommodated in the toner accommodating portion 79 is supplied onto the supply roller 27, which in turn supplies the toner to the developing roller 16. The toner is positively tribocharged between the supply roller 27 and the developing roller 16. A uniform thin layer of toner is carried on a surface of the developing roller 16.

In the meantime, a Scorotron charger 26 applies a uniform charge of positive polarity to a surface of the corresponding photosensitive drum 15. Subsequently, an LED unit 12 exposes the surface of the corresponding photosensitive drum 15 to light based on prescribed image data. An electrostatic latent image corresponding to the image data is formed on the surface of the photosensitive drum 15. The toner carried on the surface of the developing roller 16 is supplied to the electrostatic latent image formed on the surface of the photosensitive drum 15, thereby forming a toner image (developing agent image) on the surface of the photosensitive drum 15.

A sheet supply tray 7 is disposed at a bottom portion of the main casing 2 and accommodates sheets of paper S therein. Each sheet S is conveyed upward and then rearward along a U-shaped path by a pickup roller 8, a sheet supply roller 9, and a pair of registration rollers 10, and further conveyed toward a position between the photosensitive drums 15 and a conveying belt 19 at a prescribed timing. The conveying belt 19 conveys the sheet S rearward so that the sheet S passes sequentially through each position between the photosensitive drums 15 and corresponding transfer rollers 20. At this time, toner images in each color carried on the respective photosensitive drums 15 are sequentially transferred onto the sheet S to form a color image.

As the sheet S passes between a heating roller 21 and a pressure roller 22, the color image is thermally fixed onto the sheet S by heat and pressure.

After the color image has been fixed onto the sheet S, the sheet S is conveyed upward and then frontward along a U-shaped path to be discharged onto a discharge tray 23 provided at the top cover 6.

2. Process Cartridge (1) Drum Cartridge (1-1) Drum Frame

Figure 2:
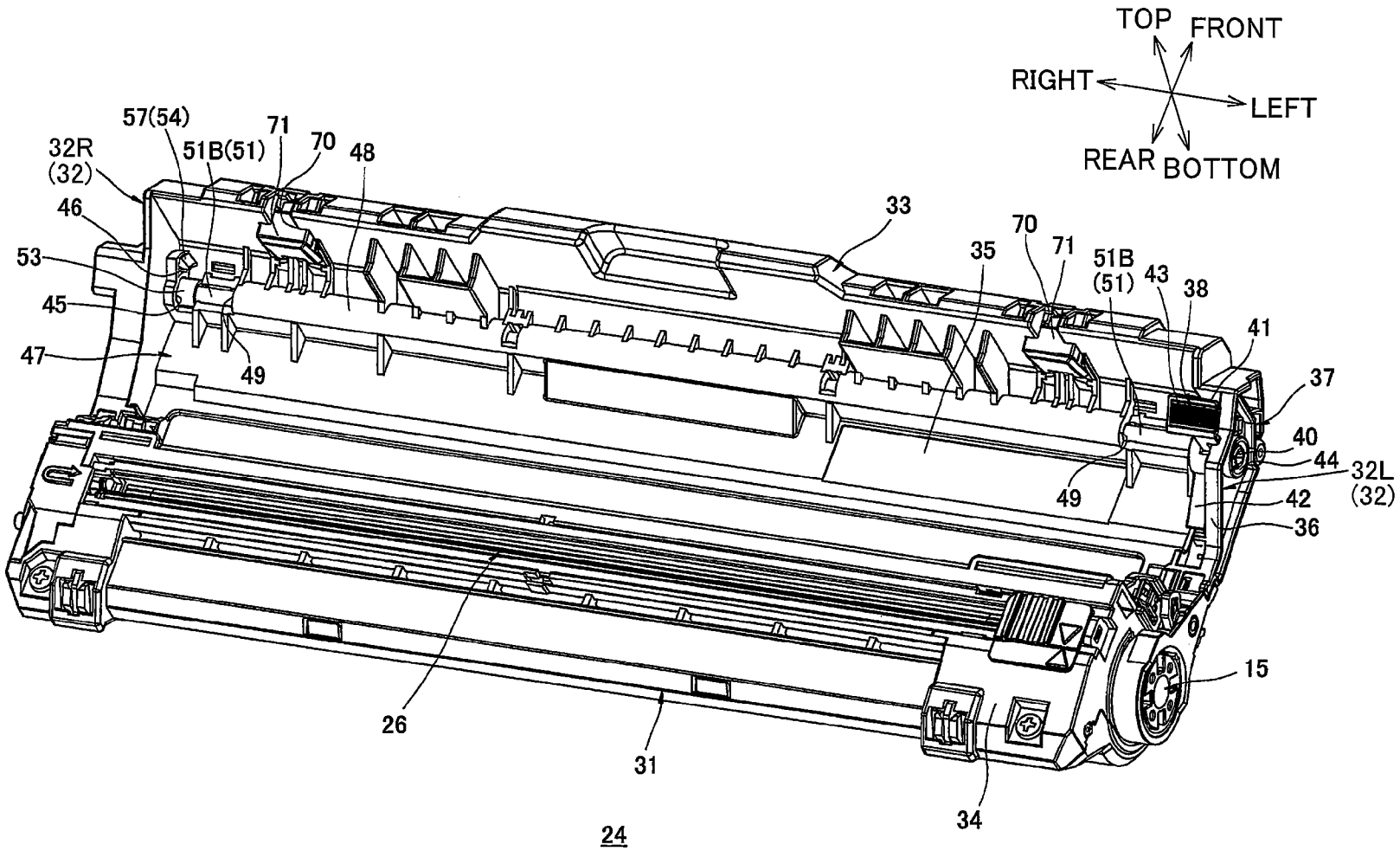
FIG. 2 is a perspective view of a drum cartridge shown in FIG. 1, as viewed from a left rear side thereof.

As shown in FIG. 2, the drum cartridge 24 includes a drum frame 31. The drum frame 31 is formed in a generally rectangular frame-like shape with a bottom wall. The drum frame 31 is elongated in the axial direction.

Note that directions related to the drum cartridge 24 in the following description will be referred based on its position when the drum cartridge 24 is disposed at a horizontal plane in an orientation such that a bottom wall 35 of the drum cartridge 24 is positioned at a bottom side (FIG. 2), unless otherwise specified. A side of the drum cartridge 24 at which the photosensitive drum 15 is disposed will be referred to as a rear side.

The drum frame 31 has a right and left pair of side walls 32, a front wall 33, a bottom wall 35, and a top wall 34. Hereinafter, the side wall 32 on the right side will be referred to as the right side wall 32R, and the side wall 32 on the left side will be referred to as a left side wall 32L when it is necessary to distinguish between the two.

Each of the side walls 32 is formed in a generally rectangular shape in a side view and elongated in the frontward/rearward direction (specifically, in a direction from an upper front side to a lower rear side of the drum frame 31). The front wall 33 bridges a front edge of the right side wall 32R and a front edge of the left side wall 32L. The bottom wall 35 bridges a bottom edge of the right side wall 32R and a bottom edge of the left side wall 32L. The top wall 34 bridges an upper edge of a rear portion of the right side wall 32R and an upper edge of a rear portion of the left side wall 32L.

The left side wall 32L is formed with a coupling exposure recess 36 for exposing a developing coupling 62 (described later) therethrough, a lock lever support hole 44, and a shaft collar engagement portion 37.

The coupling exposure recess 36 is cut out in the top edge of the left side wall 32L at a substantially center thereof in the frontward/rearward direction and depressed downward from the top edge. The coupling exposure recess 36 is formed in a generally V-shape in a side view having an open top.

The lock lever support hole 44 is disposed frontward of the coupling exposure recess 36 and penetrates the left side wall 32L. The lock lever support hole 44 has a generally circular shape in a cross-section when viewing in the rightward/leftward direction. The lock lever support hole 44 has a diameter substantially the same as that of a pivot shaft 40 (described later) of a lock lever 38 (described later).

The shaft collar engagement portion 37 is disposed at a front edge of the left side wall 32L, and downward and frontward of the lock lever support hole 44. The shaft collar engagement portion 37 is formed to be slightly depressed laterally inward (i.e. rightward) from an outer (i.e. left) surface of the left side wall 32L.

Figure 4A:
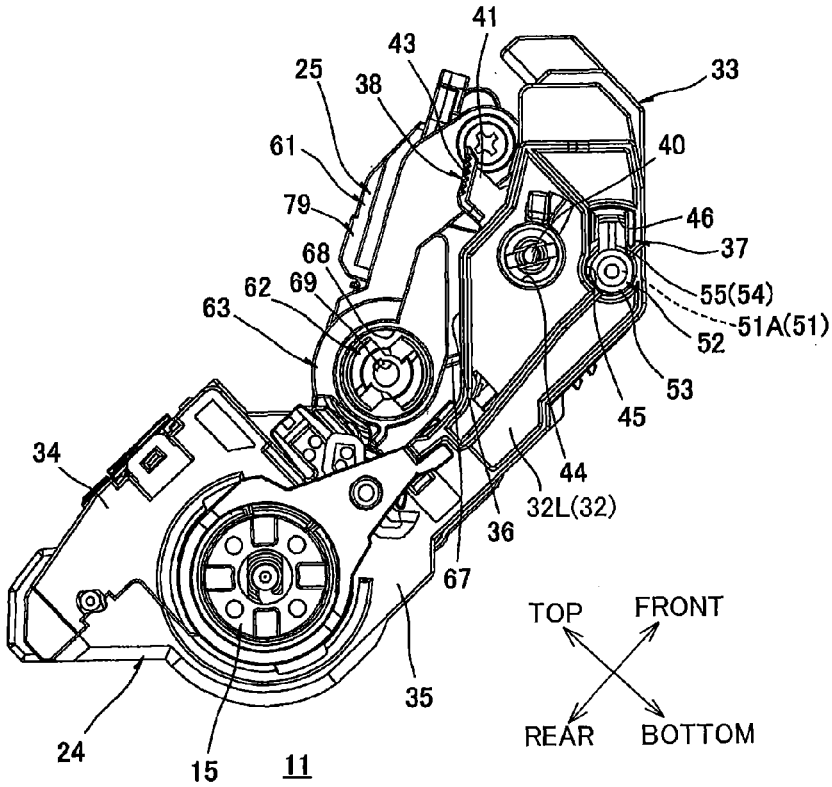
FIG. 4A is a left side view of a process cartridge shown in FIG. 1.
Figure 4B:
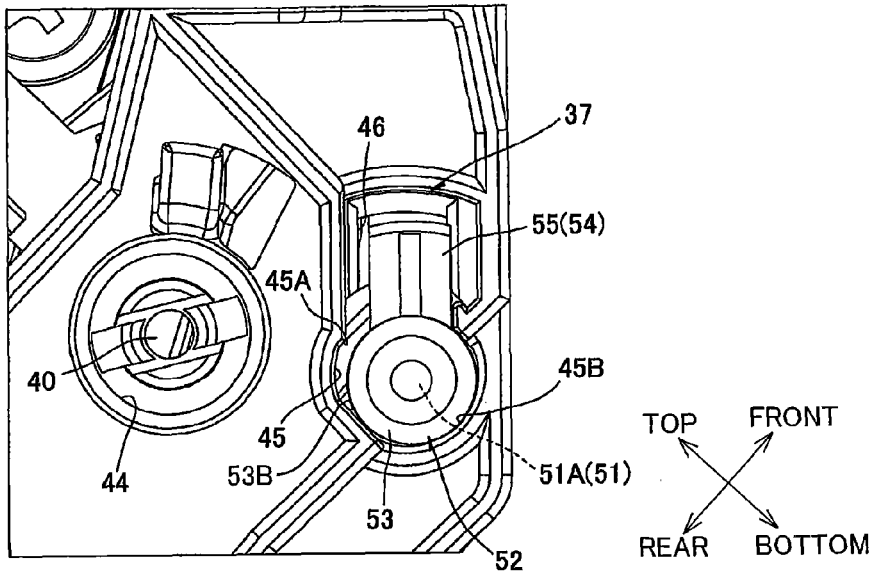
FIG. 4B is an enlarged view of an essential portion of the process cartridge shown in FIG. 4A.

As shown in FIGS. 4A and 4B, the shaft collar engagement portion 37 is formed with a collar insertion hole 45 and a collar engagement hole 46.

The collar insertion hole 45 is provided at a position below and frontward of the lock lever support hole 44. Further, the collar insertion hole 45 is positioned to overlap a shaft insertion portion 48 (described later) when projected in the rightward/leftward direction. Further, the collar insertion hole 45 penetrates the left side wall 32L. The collar insertion hole 45 has an elongated shape, in a cross-section when viewing in the rightward/leftward direction, elongated in a direction from an upper side to a lower side thereof. That is, the collar insertion hole 45 has the cross-section elongated in a perpendicular direction perpendicular to the axial direction. A collar portion 53 (described later) of a collar member 52 (described later) is inserted into the collar insertion hole 45.

As shown in FIG. 4B, the collar insertion hole 45 has an inner circumferential surface whose upper portion is represented by a first contact surface 45A and lower portion is represented by a second contact surface 45B. That is, the first contact surface 45A is in confrontation with the second contact surface 45B in the perpendicular direction.

The collar engagement hole 46 has a generally rectangular shape in a cross-section when viewing in the rightward/leftward direction. The collar engagement hole 46 is formed in the left side wall 32L at a position above and frontward of the collar insertion hole 45. An engagement claw 54 (described later) of the collar member 52 (described later) is loosely fitted into the collar engagement hole 46.

Likewise, the shaft collar engagement portion 37 is also formed in the right side wall 32R. The shaft collar engagement portion 37 of the right side wall 32R and the shaft collar engagement portion 37 of the left side wall 32L are arranged in confrontation with each other in the rightward/leftward direction.

As shown in FIG. 2, the front wall 33 is formed in a generally flat plate shape that is elongated in the rightward/leftward direction. The front wall 33 is provided with two pressure member retaining portions 70. Within each of the pressure member retaining portions 70, a pressure member 71 is retained.

One of the pressure member retaining portions 70 is disposed at a right end portion of the front wall 33, and remaining one of the pressure member retaining portions 70 is disposed at a left end portion of the front wall 33. Each of the pressure member retaining portions 70 has a generally rectangular shape in a front view. More specifically, each of the pressure member retaining portions 70 is depressed frontward from a rear surface of the front wall 33.

Each pressure member 71 is formed in a generally pillar shape having a generally rectangular shape in a front view. Each pressure member 71 is urged by an urging member (not shown) so as to normally protrude rearward from the corresponding pressure member retaining portion 70. That is, each pressure member 71 is configured to press the developing cartridge 25 toward the photosensitive drum 15 when the developing cartridge 25 is attached to the drum cartridge 24.

The bottom wall 35 is connected to a bottom edge of the front wall 33. The bottom wall 35 is formed in a generally flat plate shape that is elongated in the frontward/rearward direction and in the rightward/leftward direction.

The top wall 34 is formed in a generally flat plate shape that is elongated in the rightward/leftward direction. The top wall 34 is disposed so as to cover the photosensitive drum 15 from a top side thereof. Further, the top wall 34 supports the Scorotron charger 26.

Within the drum frame 31, a developing cartridge mounting portion 47 is defined by the pair of side walls 32, the front wall 33, a front half portion of the bottom wall 35, and the photosensitive drum 15. The developing cartridge mounting portion 47 is adapted to accommodate the developing cartridge 25 therein.

Further, within the developing cartridge mounting portion 47, a shaft insertion portion 48 is provided at a position where the front wall 33 and the bottom wall 35 is connected to each other. In other words, the shaft insertion portion 48 is disposed at the bottom edge of the front wall 33 and also at a front edge of the bottom wall 35.

The shaft insertion portion 48 is generally in a form of a hollow cylindrical shape. The shaft insertion portion 48 extends across substantially the entire width of the developer cartridge mounting portion 47 in the rightward/leftward direction. That is, the shaft insertion portion 48 has a length in the rightward/leftward direction substantially the same as that of the developer cartridge mounting portion 47. Further, each of right and left end portions of the shaft insertion portion 48 is formed with an exposure opening 49 for exposing a part of each of right and left end portions of a positioning shaft 51 (described later) therethrough.

Each exposure opening 49 has a generally rectangular shape in a plan view such that an upper half portion of the shaft insertion portion 48 is cut out.

(1-2) Lock Lever

The lock lever 38 is provided at the developing cartridge mounting portion 47 of the drum cartridge 24 at a position frontward of the coupling exposure recess 36 and rightward from the left side wall 32L (i.e. laterally inward of the left side wall 32L). The lock lever 38 is adapted to maintain the developing cartridge 25 in a mounted state. That is, the lock lever 38 is configured to prohibit detachment of the developing cartridge 25 from the drum cartridge 24.

The lock lever 38 is integrally provided with the pivot shaft 40, an operation portion 41 extending upward from the pivot shaft 40, and a lift portion 42 extending diagonally below and rearward from the pivot shaft 40.

The pivot shaft 40 is formed in a generally cylindrical shape extending in the rightward/leftward direction.

The operation portion 41 is formed in a generally lever shape extending upward from a right end portion of the pivot shaft 40. The operation portion 41 protrudes upward than an upper edge of the left side wall 32L. The operation portion 41 has an upper portion at which a restricting portion 43 is provided. The restricting portion 43 is formed in a generally flat plate shape that is elongated in the rightward/leftward direction. The restricting portion 43 has a right edge that protrudes rightward than a right edge of the pivot shaft 40. The right edge of the restricting portion 43 thus protrudes into an attachment and detachment path of the developing cartridge 25 relative to the drum cartridge 24.

The lift portion 42 is formed in a generally lever shape extending diagonally below and rearward from the right end portion of the pivot shaft 40.

The pivot shaft 40 has a left end portion that rotatably extends through the lock lever support hole 44 formed in the left side wall 32L. Hence, the lock lever 38 is supported to the side walls 32 and pivotally movable about an axis of the pivot shaft 40 between a lock position (FIG. 4A) in which the operation portion 41 upstands and an unlock position (not shown) in which the operation portion 41 is inclined.

The lock lever 38 is urged by an urging member (not shown) in a counterclockwise direction as viewed from a left side, so that the lock lever 38 is normally positioned at the lock position.

(1-3) Positioning Shaft

As shown in FIGS. 2, 3, 4A, 4B, the positioning shaft 51 is provided in the developing cartridge mounting portion 47 of the drum cartridge 24.

Figure 3:
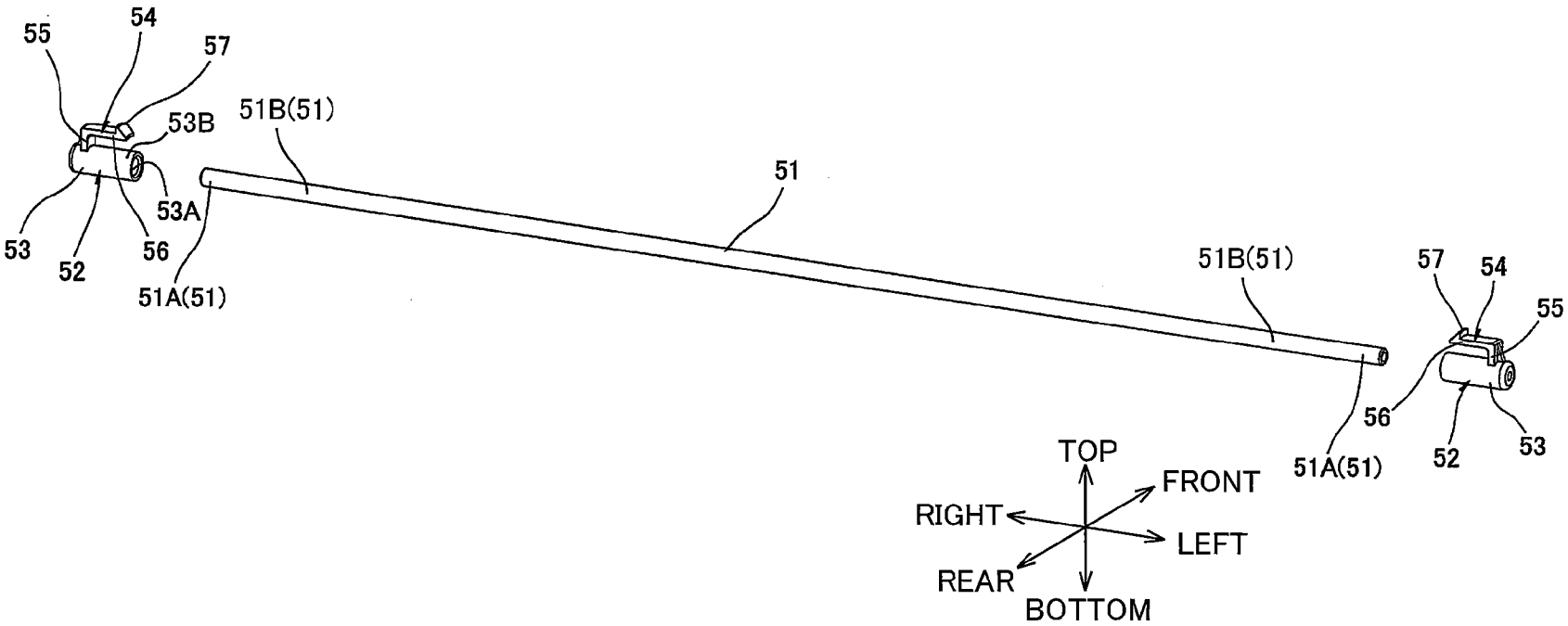
FIG. 3 is a perspective view of a positioning shaft provided at the drum cartridge shown in FIG. 2, as viewed from a left rear side thereof.

Note that directions related to the positioning shaft 51 and the collar member 52 will be referred based on its position when the collar member 52 is disposed in an orientation such that the abutment claw 54 of the collar member 52 is positioned at a top side (FIG. 3) when described while referring to FIG. 3.

As shown in FIG. 3, the positioning shaft 51 is formed in a generally cylindrical shape extending in the rightward/leftward direction. The positioning shaft 51 is made of metal. The positioning shaft 51 has a lateral (right to left) length substantially the same as that of the drum frame 31. The positioning shaft 51 has right and left ends exposed on the outside of the drum frame 31 in the rightward/leftward direction through the right and left collar insertion holes 45 formed in the drum frame 31.

Further, each of the right and left ends of the positioning shaft 51 is loosely fitted into the collar member 52.

Each collar member 52 is integrally provided with a collar portion 53 and the engagement claw 54.

The collar portion 53 is formed in a generally hollow cylindrical shape extending in the rightward/leftward direction and having a closed laterally outer end. The collar portion 53 has an inner diameter that is substantially the same as (slightly greater than) an outer diameter of the positioning shaft 51. The collar portion 53 has an outer diameter that is smaller than an inside dimension of the collar insertion hole 45. The collar portion 53 has an inner circumferential surface 53A and an outer circumferential surface 53B, as shown in FIG. 3. The outer circumferential surface 53B is disposed outward of the inner circumferential surface 53A in a radial direction of the positioning shaft 51.

As shown in FIG. 3, the engagement claw 54 is formed in a generally L-shape having a first portion 55 and a second portion 56. The first portion 55 extends upward from an upper edge of a laterally outer end portion of the collar portion 53. The second portion 56 extends laterally inward from a top portion of the first portion 55. Further, the second portion 56 has a laterally inner end portion that is provided with a claw portion 57. The second portion 56 of the engagement claw 54 has a size (a front-to-rear dimension and a vertical dimension) that is smaller than a size (an inside dimension) of the collar engagement hole 46.

The claw portion 57 is formed in a generally hook shape, protruding upward from an upper edge of the second portion 56.

As shown in FIGS. 2 and 3, the positioning shaft 51 extends through the shaft insertion portion 48 such that the right and left ends (hereinafter each referred to as a protruding end portion 51A) are respectively exposed on the outside of the drum frame 31 in the rightward/leftward direction through the right and left collar insertion holes 45. Further, the positioning shaft 51 is rotatably supported to the shaft insertion portion 48. Further, the positioning shaft 51 is positioned between the front wall 33 and the photosensitive drum 15 in the frontward/rearward direction.

Further, the positioning shaft 51 has portions (hereinafter each referred to as an exposed portion 51B) at right and left portions of the positioning shaft 51. The right and left exposed portions 51B are respectively located at positions laterally inward of the right and left protruding end portions 51A. The right and left exposed portions 51B are exposed to the outside through the exposure opening 49 of the shaft insertion portion 48. Further, the positioning shaft 51 has a center portion in the rightward/leftward direction. The center portion is covered by the shaft insertion portion 48.

Each collar member 52 is assembled to the side wall 32 from a laterally outside thereof, such that the collar portion 53 is loosely fitted onto the lateral end of the positioning shaft 51 (protruding end portion 51A) and also loosely fitted into the collar insertion hole 45, and the engagement claw 54 is loosely fitted into the collar engagement hole 46. Each protruding end portion 51A of positioning shaft 51 is supported to the collar portion 53 and rotatable relative to the collar portion 53.

The first portion 55 of the engagement claw 54 is abuttable on a peripheral region of the collar insertion hole 45 from a laterally outside thereof. That is, the first portion 55 is abuttable on a laterally outer surface of the side wall 32 from a laterally outside thereof. Further, the claw portion 57 of the second portion 56 of the engagement claw 54 is abuttable on a peripheral region of the collar engagement hole 46 from a laterally inside thereof. That is, the claw portion 57 is abuttable on a laterally inner surface of the side wall 32 from a laterally inside thereof. Hence, the side plate 32 is interposed between the first portion 55 and the claw portion 57, thereby regulating lateral movement of the collar member 52.

With this configuration, the collar member 52 is supported to the side walls 32 such that the collar portion 53 is slightly movable relative to the collar insertion hole 45 in a longitudinal direction of the collar insertion hole 45 (i.e. the direction from the upper side to the lower side thereof in FIG. 4B corresponding to the perpendicular direction).

More specifically, the collar member 52 is movable between a first position (FIG. 6B) where the collar portion 53 is abuttable on the first contact surface 45A of the inner circumferential surface of the collar insertion hole 45 and a second position (FIG. 4B) where the collar portion 53 is abuttable on the second contact surface 45B of the inner circumferential surface of the collar insertion hole 45.

(2) Developing Cartridge

Figure 5:
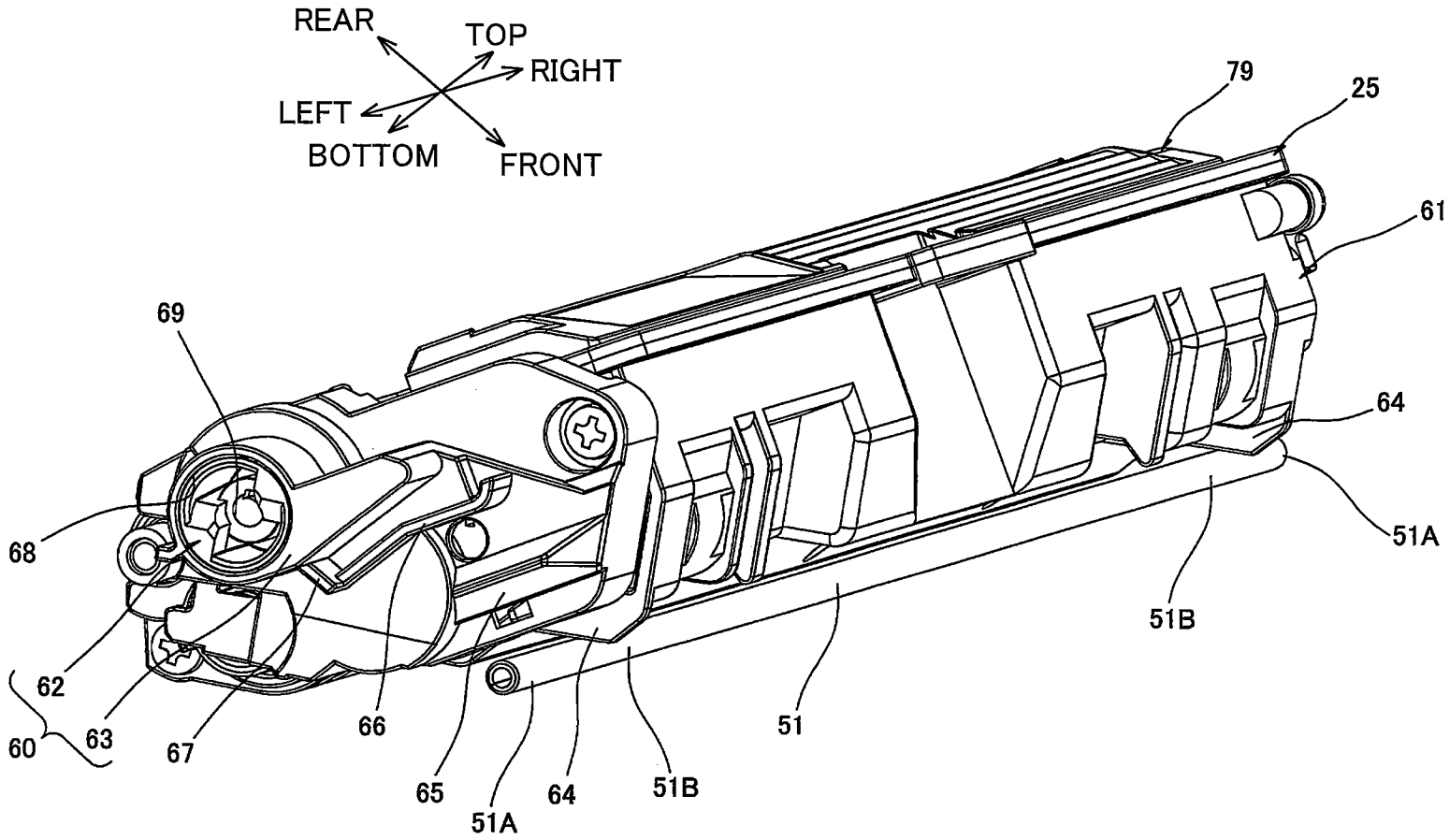
FIG. 5 is an explanatory view for illustrating positioning of a developing cartridge relative to the drum cartridge.

As shown in FIG. 5, the developing cartridge 25 includes a developing frame 61 and a drive unit 60 disposed leftward of the developing frame 61.

Note that, unless otherwise specified, directions related to the developing cartridge 25 in the following description will be referred based on its position when the developing cartridge 25 is disposed at a horizontal plane in an orientation such that the developing roller 16 is positioned at a rear side of the developing cartridge 25 and the thickness-regulating blade 28 is positioned at a top side of the developing cartridge 25 (FIG. 5).

The developing frame 61 is formed in a generally box shape that is elongated in the rightward/leftward direction. The developing frame 61 is provided with two abutment ribs 64. Each of the abutment rib 64 is abuttable on the positioning shaft 51 of the drum cartridge 24.

The abutment ribs 64 are arranged spaced apart from each other in the rightward/leftward direction at positions corresponding to the exposure openings 49 formed in the shaft insertion portion 48 of the drum cartridge 24. That is, the abutment ribs 64 are disposed at right and left end portions of the developing frame 61. Each of the abutment ribs 64 is a projection that projects downward from a lower surface of the developing frame 61 and that is also elongated in the frontward/rearward direction.

The drive unit 60 is provided with the developing coupling 62 and a gear cover 63.

The developing coupling 62 is formed in a generally cylindrical shape extending in the rightward/leftward direction. The developing coupling 62 has a left end wall formed with a recessed connection portion 69. The developing coupling 62 is rotatably accommodated in the gear cover 63 such that the recessed connection portion 69 is exposed through a coupling exposure opening 68 (described later).

Incidentally, the main casing 2 is provided with a main casing coupling (not shown), and a leading end of the main casing coupling is non-rotatably inserted into the recessed connection portion 69 of the developing coupling 62 when the developing cartridge 25 is mounted in the main casing 2. A drive force generated on the main casing 2 side is inputted into the developing coupling 62 through the main casing coupling (not shown). The inputted drive force is transmitted to the developing roller 16 and the supply roller 27 from the developing coupling 62 via a gear train (not shown) provided in the gear cover 63.

The gear cover 63 is formed in a generally cylindrical shape with a closed left end, elongated in the rightward/leftward direction. The gear cover 63 is formed with the coupling exposure opening 68. The gear cover 63 is also provided with a pressed portion 67, a restricted portion 66, and a protruding portion 65.

The coupling exposure opening 68 is formed in a left end wall of the gear cover 63 and has a generally circular shape in a cross-section when viewing in the rightward/leftward direction. The coupling exposure opening 68 penetrates the left end wall of the gear cover 63 at a substantially center portion thereof in the frontward/rearward direction, thereby exposing the left end surface of the developing coupling 62 through the coupling exposure opening 68.

The pressed portion 67 is a protrusion that protrudes leftward from a left end surface of the gear cover 63 at a position frontward of the coupling exposure opening 68. The pressed portion 67 also extends in the frontward/rearward direction.

The restricted portion 66 has a lower end that is connected to a front end of the pressed portion 67. The restricted portion 66 is a protrusion that protrudes leftward from the left end surface of the gear cover 63 and extends diagonally upward and frontward from the front end of the pressed portion 67.

The protruding portion 65 is spaced apart from the restricted portion 66 and disposed downward and frontward of the restricted portion 66. The protruding portion 65 is formed in a generally wedge shape, protruding leftward from the left end surface of the gear cover 63.

3. Mounting of Process Cartridge Relative to Main Casing (1) Attachment and Detachment of Developing Cartridge Relative to Drum Cartridge In order to mount the process cartridge 11 in the main casing 2, initially, the developing cartridge 25 is attached to the drum cartridge 24.

Attachment of the developing cartridge 25 to the drum cartridge 24 and detachment of the developing cartridge 25 from the drum cartridge 24 will be described while referring to FIGS. 2 and 5.

Note that directions in the following description related to attachment and detachment of the developing cartridge 25 relative to the drum cartridge 24 will be referred based on a position when the process cartridge 11 is disposed at a horizontal plane in an orientation such that the bottom wall 35 of the drum cartridge 24 is positioned at a bottom side. Further, a side of the developing cartridge 25 to which the developing roller 16 is supported will be referred to as a rear side of the developing cartridge 25 and a side of the developing cartridge 25 to which the thickness-regulating blade 28 is supported will be referred to as a top side of the developing cartridge 25.

In order to attach the developing cartridge 25 to the drum cartridge 24, the developing cartridge 25 is positioned above the developer cartridge mounting portion 47 of the drum cartridge 24.

Subsequently, a rear end portion of the developing cartridge 25 is inserted into a rear end portion of the developer cartridge mounting portion 47 so that the developing roller 16 is brought into contact with the photosensitive drum 15 from a front side thereof.

Next, a front end portion of the developing cartridge 25 is pushed into a front end portion of the developer cartridge mounting portion 47 so that the front end portion of the developing cartridge 25 is pivotally moved about the rear end portion of the developing cartridge 25 in a clockwise direction as viewed from a left side.

Then, the pressure members 71 of the drum cartridge 24 are brought into abutment with the front end portion of the developing cartridge 25 from a top side thereof. Further, a front end portion of the protruding portion 65 of the developing cartridge 25 is brought into abutment with the restricting portion 43 of the lock lever 38 of the drum cartridge 24 from a top side thereof.

As the front end portion of the developing cartridge 25 is further pushed into the front end portion of the developer cartridge mounting portion 47, the front end portion of the developing cartridge 25 is inserted into the front end portion of the developer cartridge mounting portion 47 while pushing the pressure members 71 frontward against the urging force from the urging members (not shown) that urge the pressure members 71.

At this time, the lock lever 38 is pressed frontward by the protruding portion 65 of the developing cartridge 25. As a result, against the urging force from the urging member (not shown) of the lock lever 38, the lock lever 38 is pivotally moved in the clockwise direction as viewed from a left side to be positioned at the unlock position. In association with the movement of the developing cartridge 25, the protruding portion 65 is also pivotally moved in the clockwise direction as viewed from a left side so as to be moved past a right front side of the lock lever 38.

Then, when the developing cartridge 25 has been completely accommodated in the developer cartridge mounting portion 47, the front end portion of the developing cartridge 25 is pressed rearward by the urging force from the urging members (not shown) that urge the pressure members 71.

At this time, each abutment rib 64 of the developing cartridge 25 is brought into abutment with the exposed portion 51B of the positioning shaft 51 exposed through the corresponding exposure opening 49 formed in the shaft insertion portion 48 from a top side of the positioning shaft 51.

Further, at this time, because each abutment ribs 64 is in abutment with the positioning shaft 51 from the top side thereof, each collar member 52 is pressed downward to be positioned at the second position (FIG. 4B). At this time, the lower portion of the outer circumferential surface 53B of the collar portion 53 (in FIG. 3, a lower front portion of the outer circumferential surface 53B) is brought into abutment with the second contact surface 45B of the inner circumferential surface of the collar insertion hole 45 from a top side thereof.

With this configuration, the developing cartridge 25 is subjected to positioning relative to the exposed portions 51B of the positioning shaft 51 by each abutment rib 64, thereby positioning the developing cartridge 25 relative to the drum cartridge 24.

Incidentally, upon completion of mounting of the developing cartridge 25 in the developer cartridge mounting portion 47, the protruding portion 65 is moved past the lock lever 38 at a right front side thereof. As a result, abutment of the protruding portion 65 with the lock lever 38 is removed.

Hence, the lock lever 38 is pivotally moved by the urging force from the urging member (not shown) of the lock lever 38 in a counterclockwise direction as viewed from a left side to be again positioned at the lock position.

At this time, the restricting portion 43 of the lock lever 38 confronts the restricted portion 66 of the developing cartridge 25 from a top side thereof. Hence, the restricting portion 43 of the lock lever 38 restricts the pivotal movement of the developing cartridge 25 in the counterclockwise direction as viewed from a left side. Further, the lift portion 42 of the lock lever 38 confronts the pressed portion 67 of the developing cartridge 25 from a bottom side thereof.

As described above, attachment of the developing cartridge 25 to the drum cartridge 24 is completed.

Incidentally, when the developing cartridge 25 is attached to the drum cartridge 24, the developing roller 16 and the photosensitive drum 15 confront each other in a confronting direction.

Further, the positioning shaft 51 is positioned between the developing roller 16 and each pressure member 71 in the confronting direction when the developing cartridge 25 is attached to the drum cartridge 24.

In order to detach the developing cartridge 25 from the drum cartridge 24, initially, the restricting portion 43 of the lock lever 38 is pressed to pivotally move the lock lever 38 against the urging force from the urging member (not shown) of the lock lever 38 in the clockwise direction as viewed from a left side. Hence, the lock lever 38 is positioned at the unlock position.

Subsequently, the restricting portion 43 of the lock lever 38 is retracted frontward from the top side of the restricted portion 66 of the developing cartridge 25. Further, the lift portion 42 of the lock lever 38 presses the pressed portion 67 of the developing cartridge 25 from a bottom side thereof.

As a result, the front end portion of the developing cartridge 25 is lifted upward from the developer cartridge mounting portion 47 of the drum cartridge 24.

Then, the user holds the front end portion of the developing cartridge 25 to move the developing cartridge 25 upward, thereby detaching the developing cartridge 25 from the developer cartridge mounting portion 47 of the drum cartridge 24.

Thus, detachment of the developing cartridge 25 from the drum cartridge 24 is completed.

(2) Mounting of Process Cartridge Relative to Main Casing

Next, mounting of the process cartridge 11 relative to the main casing 2 will be described while referring to FIGS. 1, 6A, and 6B.

Figure 6A:
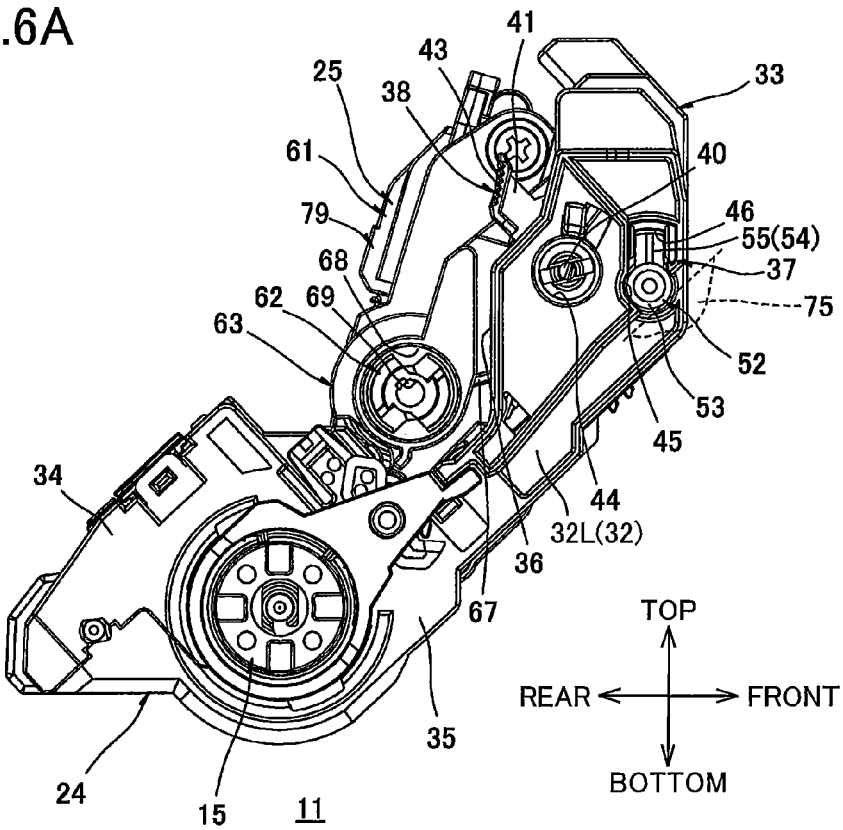

Note that, unless otherwise specified, directions in the following description related to mounting of the process cartridge 11 in the main casing 2 will be referred based on a position when the printer 1 is disposed as shown in FIG. 1 and the process cartridge 11 is disposed as shown in FIG. 6A. That is, the process cartridge 11 is mounted in the main casing 2 such that the rear portion of the process cartridge 11 at which the photosensitive drum 15 is positioned is disposed at a lower rear side of the printer 1 and a front portion of the process cartridge 11 at which the front wall 33 is positioned is disposed at an upper front side of the printer 1.

Figure 6B:
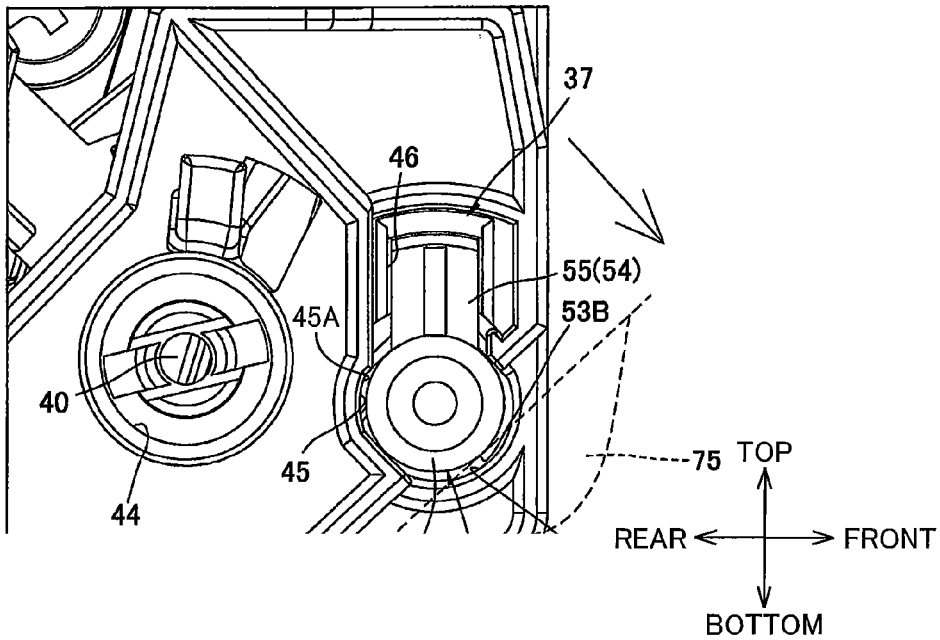

As shown in FIGS. 6A and 6B, the main casing 2 is provided with a pair of receiving portions 75 (indicated by broken lines in FIGS. 6A and 6B). Each of the receiving portion 75 is provided in the main casing 2 at a position adjacent to and outward of a lateral end of the process cartridge 11 when the process cartridge 11 is mounted in the main casing 2. When the process cartridge 11 is mounted in the main casing 2, a lower front edge of each collar member 52 is brought into abutment with the receiving portion 75 from an upper rear side thereof. Note that the lower front edge of the collar member 52 shown in FIGS. 6A and 6B corresponds to the lower edge of the collar member 52 shown in FIGS. 4A and 4B.

Further, the collar portion 53 is loosely fitted onto the protruding end portion 51A. The inner circumferential surface 53A of the collar portion 53 is contactable with the protruding end portion 51A (FIG. 3). Further, the outer circumferential surface 53B of the collar portion 53 is abuttable on the receiving portion 75 of the main casing 2 (FIG. 6B).

When the lower front edge of each collar member 52 is brought into abutment with the receiving portion 75, the collar member 52 is pressed upward and rearward by a reactive force from the receiving portion 75. Each collar member 52 is then positioned at the first position (FIG. 6B). At this time, as shown in FIG. 6B, an upper rear portion of the outer circumferential surface 53B of the collar portion 53 is brought into abutment with the first contact surface 45A of the inner circumferential surface of the collar insertion hole 45 from a lower front side thereof. Note that the upper rear portion of the outer circumferential surface 53B shown in FIGS. 6A and 6B corresponds to the upper portion of the outer circumferential surface 53B shown in FIGS. 4A and 4B.

As described above, the process cartridge 11 is subjected to positioning relative to the main casing 2 upon abutment of the protruding end portions 51A with the receiving portions 75. Hence, mounting of the process cartridge 11 relative to the main casing 2 is completed.

4. Operations and Effects (1) In the drum cartridge 24 according to the first embodiment of the present invention, as shown in FIGS. 2, 6A, and 6B, the developing cartridge 25 is subjected to positioning relative to the right and left exposed portions 51B of the positioning shaft 51, thereby positioning the developing cartridge 25 relative to the drum cartridge 24. Further, the process cartridge 11 is subjected to positioning relative to the main casing 2 at the right and left protruding end portions 51A.

Accordingly, positioning of the developing cartridge 25 relative to the positioning shaft 51 having a high rigidity can be achieved with accuracy, thereby accurately positioning the developing cartridge 25 relative to the drum cartridge 24 via the positioning shaft 51.

Further, positioning of the drum cartridge 24 relative to the main casing 2 can be achieved with accuracy by the positioning shaft 51 having a high rigidity. Still further, positioning of the developing cartridge 25 mounted in the drum cartridge 24 relative to the main casing 2 can also be achieved with accuracy.

(2) Further, in the drum cartridge 24 according to the first embodiment, as shown in FIGS. 2, 6A, and 6B, the right and left protruding end portions 51A of the positioning shaft 51 are respectively positioned laterally outwardly from the right and left exposed portions 51B of the positioning shaft 51.

With this configuration, positioning of the developing cartridge 25 relative to the main casing 2 can be achieved with high accuracy via the positioning shaft 51.

(3) Further, in the drum cartridge 24 according to the first embodiment, as shown in FIGS. 2 and 3, the positioning shaft 51 is supported to the drum frame 31 by the collar members 52, each being fitted onto the protruding end portion 51A of the positioning shaft 51 from a laterally outside thereof.

Hence, with a simple configuration, the drum frame 31 can support the positioning shaft 51 via the collar members 52.

(4) Further, in the drum cartridge 24 according to the first embodiment, as shown in FIG. 3, each collar member 52 is provided with the collar portion 53 to which the positioning shaft 51 is rotatably supported.

With this configuration, the positioning shaft 51 is rotatable while the positioning shaft 51 is supported to the drum frame 31 via the collar members 52. Hence, when the abutment ribs 64 of the developing cartridge 25 are brought into abutment with the exposed portions 51B of the positioning shaft 51, contact resistance therebetween can be reduced.

(5) Further, in the drum cartridge 24 according to the first embodiment, as shown in FIGS. 2 and 3, each collar member 52 is provided with the first portion 55 and the claw portion 57 of the second portion 56. The first portion 55 is abuttable on the drum frame 31 from a laterally outside thereof. The claw portion 57 of the second portion 56 is abuttable on the drum frame 31 from a laterally inside thereof.

With this configuration, the drum frame 31 is interposed between the first portion 55 and the claw portion 57 of the second portion 56 in the rightward/leftward direction. Hence, lateral movement of the positioning shaft 51 supported by the collar members 52 can be restricted. As a result, displacement of the positioning shaft 51 from the drum frame 31 can be prevented.

(6) Further, in the drum cartridge 24 according to the first embodiment, as shown in FIGS. 6A and 6B, each collar member 52 (collar portion 53) has the inner circumferential surface 53A contactable with the protruding end portion 51A of the positioning shaft 51 and the outer circumferential surface 53B abuttable on the receiving portion 75 provided at the main casing 2.

With this configuration, each collar member 52 is abuttable on the receiving portion 75 of the main casing 2 at a position radially outward of the protruding end portion 51A of the positioning shaft 51 (radially outward of the positioning shaft 51). Accordingly, positioning accuracy can be enhanced compared with a case where positioning of the positioning shaft 51 relative to the main casing 2 is achieved directly by the protruding end portions 51A.

(7) Further, in the drum cartridge 24 according to the first embodiment, as shown in FIG. 4B, each collar insertion hole 45 has a cross-section elongated in the direction from the upper side to the lower side thereof (perpendicular direction) when viewing in the rightward/leftward direction. In other words, as shown in FIG. 6B, the collar insertion hole 45 has a cross-section elongated in the direction from the upper rear side to the lower front side thereof when viewing in the rightward/leftward direction. The collar portion 53 of each collar member 52 is loosely fitted into the elongated collar insertion hole 45.

Hence, when the positioning shaft 51 is brought into abutment with the receiving portions 75 in the perpendicular direction, the positioning shaft 51 can be restrained from being in impacting contact with the receiving portion 75. Thus, damages to the positioning shaft 51 and to the receiving portions 75 abuttable on the positioning shaft 51 can be prevented.

Further, positioning of the developing cartridge 25 relative to the drum cartridge 24 can be achieved with accuracy regardless of bending of the drum frame 31 or slight dimensional difference (equivalent to tolerance) thereof.

(8) Further, in the drum cartridge 24 according to the first embodiment, as shown in FIG. 6B, the collar member 52 is brought into abutment with the first contact surface 45A of the inner circumferential surface of the collar insertion hole 45 when the drum cartridge 24 is mounted in the main casing 2.

Hence, when the drum cartridge 24 is mounted in the main casing 2, the first contact surface 45A of the inner circumferential surface of the collar insertion hole 45 restricts further movement of the collar member 52. Accordingly, positioning of the positioning shaft 51 relative to the main casing 2 can be achieved with accuracy, thereby positioning the drum cartridge 24 relative to the main casing 2 with accuracy.

(9) Further, in the drum cartridge 24 according to the first embodiment, as shown in FIG. 4B, the collar member 52 is abutment with the second contact surface 45B of the inner circumferential surface of the collar insertion hole 45 when the drum cartridge 24 is dismounted from the main casing 2.

Hence, when the drum cartridge 24 is dismounted from the main casing 2 and the developing cartridge 25 is mounted in the developer cartridge mounting portion 47 of the dismounted drum cartridge 24, the collar member 52 is brought into abutment with the second contact surface 45B of the inner circumferential surface of the collar insertion hole 45. Accordingly, even when the drum cartridge 24 is dismounted from the main casing 2, rattling of the collar member 52 and the positioning shaft 51 in the first confronting direction can be reliably avoided.

(10) Further, in the drum cartridge 24 according to the first embodiment, as shown in FIG. 2, the drum frame 31 has the shaft insertion portion 48 for covering a part of the positioning shaft 51.

Hence, the positioning shaft 51 can be protected by the shaft insertion portion 48. Further, unintentional removal of the positioning shaft 51 from the drum cartridge 24 can be effectively prevented.

(11) Further, in the drum cartridge 24 according to the first embodiment, the positioning shaft 51 is made of a metallic material.

Hence, the positioning shaft 51 has an enhanced rigidity.

(12) Further, as shown in FIG. 1, the process cartridge 11 according to the first embodiment includes the drum cartridge 24 and the developing cartridge 25. The developing cartridge 25 is mountable in the developer cartridge mounting portion 47 of the drum cartridge 24.

With this configuration, positioning of the developing cartridge 25 relative to the drum cartridge 24 can be achieved with accuracy. Because the drum cartridge 24 is subjected to positioning relative to the main casing 2 with accuracy, the developing cartridge 25 can also be subjected to positioning relative to the main casing 2 with accuracy via the drum cartridge 24.

(13) Further, in the process cartridge 11 according to the first embodiment, as shown in FIG. 5, the abutment ribs 64 protruding from the developing frame 61 of the developing cartridge 25 are abuttable on the exposed portions 51B of the positioning shaft 51.

With this configuration, abutment of the abutment ribs 64 with the exposed portions 51B can achieve positioning of the developing cartridge 25 relative to the drum cartridge 24. Further, because each abutment rib 64 protrudes from the developing frame 61, degradation of positioning accuracy of the developing cartridge 25 relative to the drum cartridge 24 due to deformation of the developing frame 61 can be reduced compared with a configuration in which the developing frame 61 abuts on the exposed portions 51B entirely.

(14) Further, in the process cartridge 11 according to the first embodiment, as shown in FIG. 5, the abutment ribs 64 are disposed at the right and left end portions of the developing frame 61.

Since the developing cartridge 25 is subjected to positioning relative to the drum cartridge 24 at the right and left end portions of the developing frame 61, positioning accuracy of the developing cartridge 25 relative to the drum cartridge 24 can be further enhanced.

(15) Further, in the process cartridge 11 according to the first embodiment, as shown in FIG. 2, the positioning shaft 51 is positioned between the developing roller 16 and the pressure members 71 in the confronting direction in which the photosensitive drum 15 confronts the developing roller 16 (i.e. the direction from the front side to the rear side thereof in FIG. 2, which corresponds to the direction from the upper front side to the lower rear side thereof in FIG. 1).

Because the positioning shaft 51 is positioned between the developing roller 16 and the pressure members 71 in the direction in which the photosensitive drum 15 and the developing roller 16 confront each other, the positioning shaft 51 is abuttable on a portion of the developing cartridge 25 disposed between the front end portion and the rear end portion of the developing cartridge 25. As a result, reliable contact between the positioning shaft 51 and the developing cartridge 25 can be ensured.

5. Second Embodiment

Figure 7:
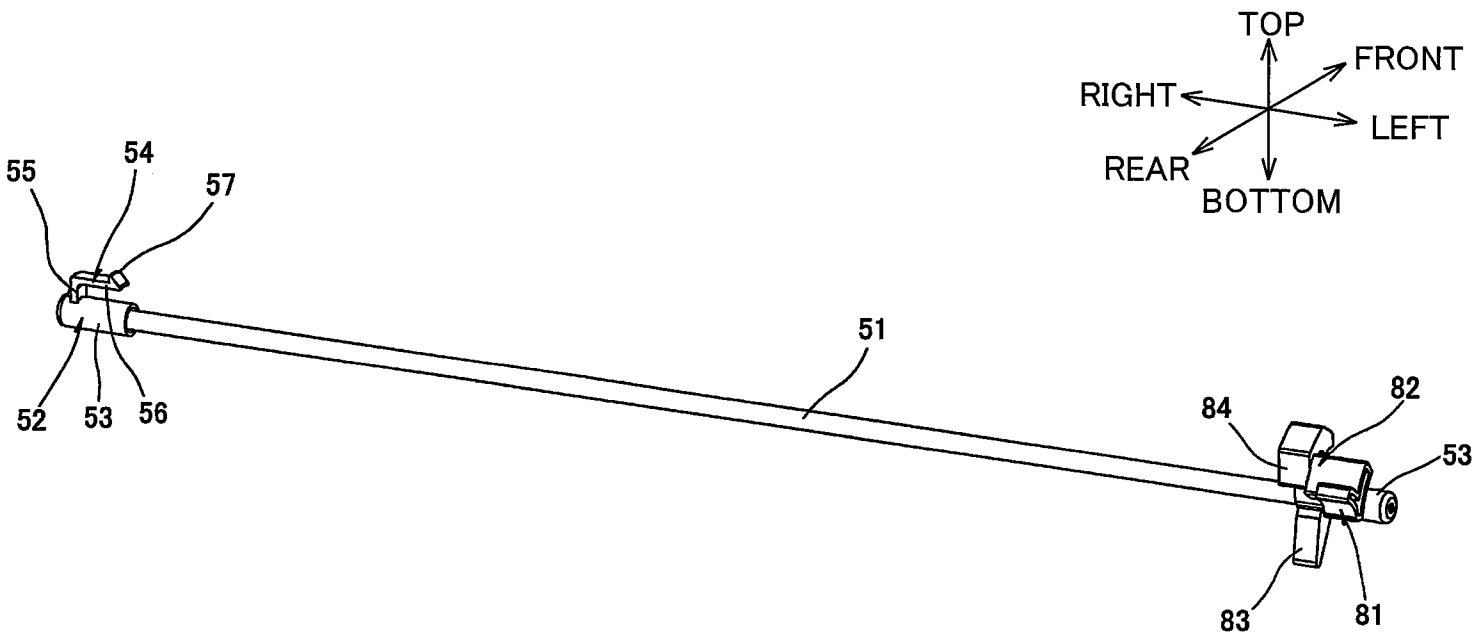
FIG. 7 is a perspective view of a positioning shaft provided at a drum cartridge according to a second embodiment of the present invention, as viewed from a left rear side thereof.
Figure 8A:
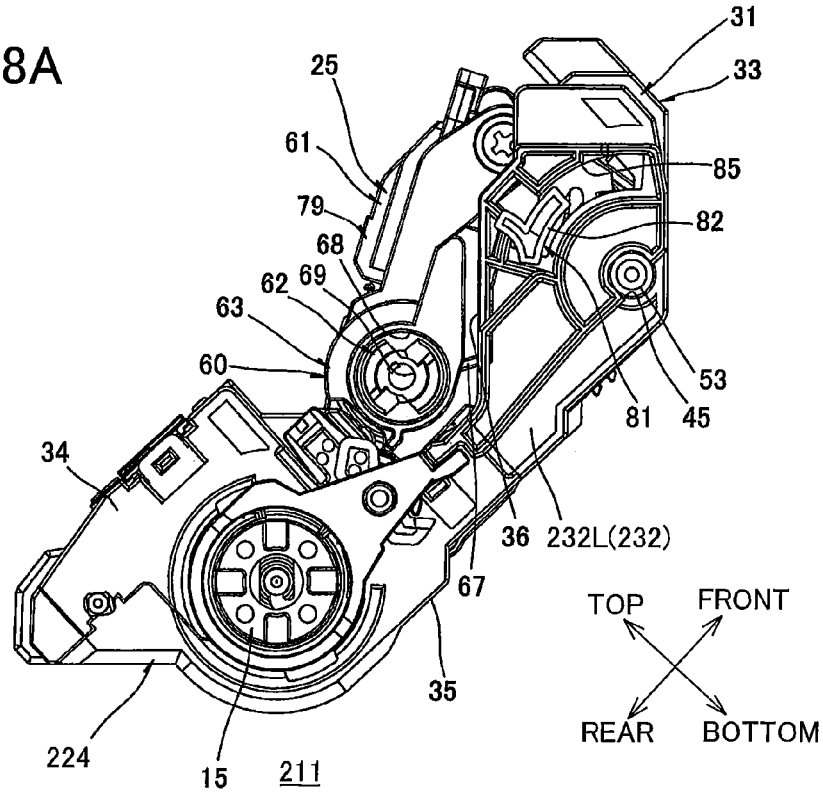
Figure 8B:
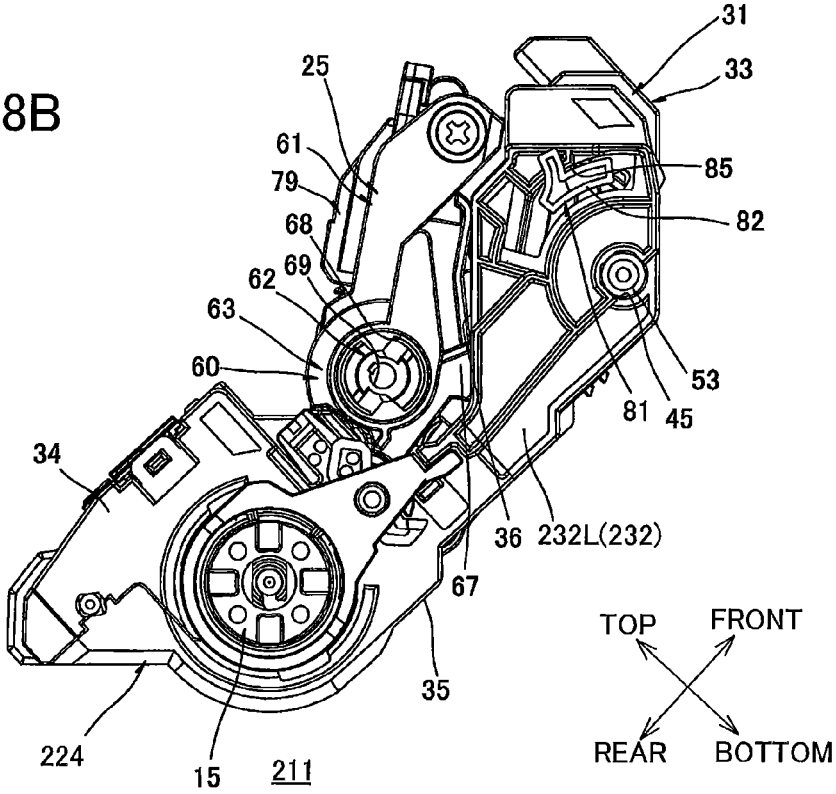

A drum cartridge 224 and a process cartridge 211 according to a second embodiment of the present invention will be descried while referring to FIGS. 7 through 8B.

In the following description, parts and components appearing in the second embodiment and the same as those in the first embodiment will be designated by the same reference numerals as those in the first embodiment to avoid duplicating description, and only parts and components differing from those of the first embodiment will be described.

In the above-described first embodiment, the right and left ends of the positioning shaft 51 are supported to the right and left side walls 32 via the collar members 52. Further, the lock lever 38 is pivotally movably supported to the left side wall 32L.

However, instead of the lock lever 38 in the first embodiment, in the second embodiment, a lock lever 81 is provided at a drum cartridge 224, as shown in FIGS. 7, 8A, 8B.

Note that directions related to the lock lever 81 will be referred based on its position shown in FIG. 7, and directions related to the drum cartridge 224 will be referred based on its position shown in FIGS. 8A and 8B, unless otherwise specified.

The lock lever 81 is provided with the collar portion 53, instead of the pivot shaft 40 of the lock lever 38. The left end of the positioning shaft 51 is supported to a left side wall 232L of the drum cartridge 224 via the collar portion 53 of the lock lever 81.

More specifically, as shown in FIG. 7, the lock lever 81 is integrally provided with the collar portion 53, a restricting portion 84 extending upward from the collar portion 53, and a lift portion 83 extending diagonally downward and rearward from the collar portion 53.

The restricting portion 84 is formed in a generally hook shape, extending upward from a right end portion of the collar portion 53 and then bending rearward. Further, the restricting portion 84 has an upper portion where an operation portion 82 is provided. The operation portion 82 is formed in a generally square pillar shape and extends leftward from a left end surface of the restricting portion 84.

The lift portion 83 is formed in a generally lever shape extending diagonally downward and rearward from the right end portion of the collar portion 53.

Further, as shown in FIGS. 8A and 8B, the left side wall 232L is formed with a lock lever exposure opening 85 for exposing the operation portion 82 of the lock lever 81. The lock lever exposure opening 85 penetrates the left side wall 232L.

The lock lever exposure opening 85 is formed in a generally arcuate shape with a center angle of approximately 60 degrees with respect to the collar insertion hole 45 as a center point of the center angle. That is, the lock lever exposure opening 85 extends from a position above the collar insertion hole 45 to a position with approximately 60 degrees therefrom in the counterclockwise direction as viewed from a left side with respect to the collar insertion hole 45. The operation portion 82 is exposed through the lock lever exposure opening 85 at a position leftward (outward in the rightward/leftward direction) of the left side wall 232L.

The collar portion 53 of the lock lever 81 is loosely fitted onto the left end of the positioning shaft 51. The positioning shaft 51 is rotatably supported to the collar portion 53 of the lock lever 81 and the collar portion 53 of the collar member 52.

The collar portion 53 of the lock lever 81 rotatably extends through the collar insertion hole 45 formed in the left side plate 232L from a right side thereof (a laterally inner side thereof). More specifically, the collar portion 53 of the lock lever 81 is fitted into the collar insertion hole 45 formed in the left side wall 232L such that the operation portion 82 is exposed through the lock lever exposure opening 85 at a position leftward (laterally outward) of the left side wall 32L.

The left end of the collar portion 53 is exposed on the outside of the left side plate 232L in the rightward/leftward direction through the collar insertion hole 45 formed in the left side wall 232L.

With this configuration, the lock lever 81 is supported to the left side wall 232L and pivotally movable about the positioning shaft 51 between a lock position (FIG. 8A) where the operation portion 82 is positioned at a rear end portion of the lock lever exposure opening 85 for prohibiting detachment of the developing cartridge 25 from the drum cartridge 224, and an unlock position (FIG. 8B) where the operation portion 82 is positioned at a front end portion of the lock lever exposure opening 85 for permitting detachment of the developing cartridge 25 from the drum cartridge 224.

Further, the lock lever 81 is urged by an urging member (not shown) in a counterclockwise direction as viewed from a left side so as to be normally positioned at the lock position.

According to the second embodiment, the number of parts and components can be reduced compared with a configuration in which the lock lever 38 is provided separately from the collar member 52 (i.e. first embodiment).

Further, the operation portion 82 of the lock lever 81 is inserted into the lock lever exposure opening 85. Accordingly, the lock lever 81 prohibits detachment of the developing cartridge 25 from the developer cartridge mounting portion 47. Therefore, undesired detachment of the developing cartridge 25 mounted in the developer cartridge mounting portion 47 from the drum cartridge 224 can be reliably prevented.

According to the second embodiment, the lock lever 81 is pivotally movable between the lock position (FIG. 8A) and the unlock position (FIG. 8B) about the positioning shaft 51.

Hence, with a simple operation to pivotally move the lock lever 81, prohibition and permission of detachment of the developing cartridge 25 from the drum cartridge 24 can be achieved.

While the present invention has been described in detail with reference to the present embodiments thereof, it would be apparent to those skilled in the art that various changes and modifications may be made therein without departing from the spirit of the present invention.

What is claimed is:

1. A photosensitive member cartridge configured to be mounted in a main casing of an image forming apparatus and configured to accommodate therein a developing cartridge having a developing agent bearing member, the photosensitive member cartridge comprising:

a photosensitive member having an axis extending in an axial direction;

a mounting portion configured to accommodate the developing cartridge therein;

a shaft extending in the axial direction and including:

a first abutment portion configured to be abutted on the developing cartridge when the developing cartridge is mounted in the mounting portion; and a positioned portion configured to be subjected to positioning with respect to the main casing when the photosensitive member cartridge is mounted in the main casing;

a photosensitive member frame configured to accommodate the photosensitive member therein; and an engagement member configured to be engaged with the photosensitive member frame so as to support at least one axial end portion of the shaft, the engagement member including a support portion to which the shaft is rotatably supported.

2. The photosensitive member cartridge as claimed in claim 1, wherein the positioned portion is disposed outward of the first abutment portion in the axial direction.

3. The photosensitive member cartridge as claimed in claim 1, wherein the photosensitive member frame has a wall having a first side and a second side opposite to the first side in the axial direction; and wherein the engagement member further includes:

a first restriction portion configured to be abutted on the first side, and a second restriction portion disposed opposite to the first restriction portion with respect to the wall, the second restriction portion being configured to be abutted on the second side.

4. The photosensitive member cartridge as claimed in claim 1, wherein the engagement member further includes:

a contact portion configured to contact the positioned portion; and a second abutment portion disposed outward of the contact portion in a radial direction of the shaft, the second abutment portion being configured to be abutted on the main casing when the photosensitive member cartridge is mounted in the main casing.

5. The photosensitive member cartridge as claimed in claim 1, wherein the photosensitive member frame has a retaining hole that retains the engagement member therein, the retaining hole having an elongated shape, in a cross-section when viewing in the axial direction, elongated in a perpendicular direction perpendicular to the axial direction.

6. The photosensitive member cartridge as claimed in claim 5, wherein the retaining hole has a first contact surface being configured to contact the engagement member when the photosensitive member cartridge is mounted in the main casing.

7. The photosensitive member cartridge as claimed in claim 6, wherein the retaining hole has a second contact surface positioned in confrontation with the first contact surface in the perpendicular direction, the second contact surface being configured to contact the engagement member when the photosensitive member cartridge is being dismounted from the main casing and when the developing cartridge is mounted in the mounting portion.

8. The photosensitive member cartridge as claimed in claim 1, wherein the photosensitive member frame includes a cover portion covering a part of the shaft.

9. The photosensitive member cartridge as claimed in claim 8, wherein the first abutment portion and the positioned portion are located at a remaining part of the shaft other than the part covered by the cover portion.

10. The photosensitive member cartridge as claimed in claim 1, wherein the photosensitive member frame is elongated in the axial direction and has end portions in the axial direction, and the photosensitive member cartridge further comprising a lock member disposed at least one of the end portions, the lock member being configured to prohibit detachment of the developing cartridge from the mounting portion.

11. The photosensitive member cartridge as claimed in claim 1, further comprising a lock member disposed at least one axial end portion of the shaft, and configured to prohibit detachment of the developing cartridge from the mounting portion.

12. The photosensitive member cartridge as claimed in claim 11, wherein the lock member is configured to be rotationally moved about the shaft between a lock position at which detachment of developing cartridge from the mounting portion is prohibited and an unlock position at which the developing cartridge is detachable from the mounting portion.

13. The photosensitive member cartridge as claimed in claim 1, wherein the shaft is made from a metallic material.

14. A process cartridge comprising:

the photosensitive member cartridge as claimed in claim 1; and a developing cartridge configured to be mounted in the mounting portion of the photosensitive member cartridge.

15. The process cartridge as claimed in claim 14, wherein the developing cartridge comprises:

a developing frame provided with a developing agent accommodating portion that is configured to accommodate therein a developing agent for supplying to the photosensitive member; and a projecting portion provided at the developing frame, and projecting toward the shaft when the developing cartridge is mounted in the mounting portion, wherein the first abutment portion is configured to be abutted on the projecting portion when the developing cartridge is mounted in the mounting portion.

16. The process cartridge as clamed in claim 15, wherein the developing frame is elongated in the axial direction and has end portions in the axial direction, and wherein the projecting portion includes projecting elements disposed at both end portions of the developing frame in the axial direction.

17. The process cartridge as claimed in claim 14, wherein the photosensitive member cartridge comprises a pressure member configured to press the developing cartridge toward the photosensitive member, the developing agent bearing member confronting the photosensitive member when the developing cartridge is mounted in the mounting portion, wherein the photosensitive member and the developing agent bearing member confront each other in a confronting direction when the developing cartridge is mounted in the mounting portion; and wherein the shaft is positioned between the developing agent bearing member and the pressure member in the confronting direction when the developing cartridge is mounted in the mounting portion.

* * * * *